US009990881B2

(12) United States Patent
Kimura et al.

(10) Patent No.: US 9,990,881 B2
(45) Date of Patent: Jun. 5, 2018

(54) DISPLAY DEVICE AND DRIVING METHOD THEREOF

(71) Applicant: Japan Display Inc., Tokyo (JP)

(72) Inventors: Hiroyuki Kimura, Tokyo (JP); Duzen Peng, Tokyo (JP); Ilin Wu, Tokyo (JP)

(73) Assignee: Japan Display Inc., Tokyo (JP)

( * ) Notice: Subject to any disclaimer, the term of this patent is extended or adjusted under 35 U.S.C. 154(b) by 87 days.

(21) Appl. No.: 15/083,874

(22) Filed: Mar. 29, 2016

(65) Prior Publication Data

US 2016/0293103 A1 Oct. 6, 2016

(30) Foreign Application Priority Data

Apr. 2, 2015 (JP) ..... 2015-076061

(51) Int. Cl.
*G09G 3/32* (2016.01)
*G09G 3/3233* (2016.01)

(52) U.S. Cl.
CPC ..... *G09G 3/3233* (2013.01); *G09G 2300/043* (2013.01); *G09G 2300/0819* (2013.01); *G09G 2300/0842* (2013.01); *G09G 2300/0861* (2013.01); *G09G 2310/0216* (2013.01); *G09G 2310/0251* (2013.01); *G09G 2310/0254* (2013.01)

(58) Field of Classification Search
CPC ..... G09G 3/32; G09G 3/3208; G09G 3/3225–3/329; G09G 2300/043; G09G 2300/0809; G09G 2300/0819; G09G 2300/0842; G09G 2300/0861; G09G 2300/0866; G09G 2310/0216; G09G 2310/0243; G09G 2310/0248; G09G 2310/0251; G09G 2310/0254; G09G 2320/02; G09G 2320/0233
See application file for complete search history.

(56) References Cited

U.S. PATENT DOCUMENTS

2010/0033477 A1* 2/2010 Yamashita ..... G09G 3/3233 345/215
2014/0111557 A1* 4/2014 Omata ..... G09G 3/3233 345/690

FOREIGN PATENT DOCUMENTS

JP 2014-085384 A 5/2014

* cited by examiner

*Primary Examiner* — Nathan Danielsen
(74) *Attorney, Agent, or Firm* — Typha IP LLC

(57) ABSTRACT

A method of driving a display device includes the following steps: a step of applying a first voltage to a drain of the driving transistor from the first power supply line, while applying an initialization voltage lower than the first voltage to a gate of the driving transistor; a step of applying a voltage higher than the initialization voltage lower than the first voltage to the drain of the driving transistor, and applying a voltage based on a video signal to the gate of the driving transistor; and a step of applying the first voltage to a drain of the driving transistor from the first power supply line and supplying a current to the light emitting element while holding the voltage based on the video signal to the gate of the driving transistor.

7 Claims, 16 Drawing Sheets

DISPLAY DEVICE AND DRIVING METHOD THEREOF

CROSS REFERENCE TO RELATED APPLICATIONS

This application is based upon and claims the benefit of priority from the prior Japanese Patent Application No. 2015-076061, filed on Apr. 2, 2015, the entire contents of which are incorporated herein by reference.

FIELD

The present invention is related to a display device and one embodiment of the invention disclosed in the present specification is related to a display device arranged with a light emitting element arranged in a pixel and a method of driving the display device.

BACKGROUND

A light emitting element is known having a structure in which a pair of electrodes distinguished as an anode and a cathode sandwich an electroluminescence material. The light emitting element emits light when a certain potential difference is supplied between the anode and the cathode and the intensity of the emitted light can be controlled by the amount of current which flows to the light emitting element.

Display devices formed with a pixel using such a light emitting element are being developed. A driving transistor which controls a current flowing to a light emitting element and a circuit which controls the operation of the driving transistor are further arranged in each pixel. The intensity of the emitted light is controlled by a current value. As a result, it is necessary for the driving transistor to accurately control the current value. The luminosity of the light emitting element is affected and becomes varied between pixels when there is variation in the characteristics of a driving transistor and therefore a technology is necessary to correct this.

In order to correct this, a display device is disclosed in Japanese Laid Open Patent No. 2014-085384 in which a circuit for compensating for characteristic variation of a driving transistor is arranged in each pixel. In addition to a driving transistor which is electrically connected to a light emitting element, a pixel in this display device has a structure which also includes a capacitor element electrically connected between the gate and source of the driving transistor, a switching element which electrically controls a connection between the gate and a signal line, a switching element which electrically controls a connection between the drain of the driving transistor and a high voltage power supply line, and a switching element which electrically controls a connection between the source and a reset signal line.

SUMMARY

A method of driving a display device in an embodiment according to the present invention, the display device includes a plurality of pixels, each of the plurality of pixels includes a light emitting element arranged between a first power supply line applied with a first voltage and a second power supply line applied with a second voltage lower than the first voltage, and a driving transistor controlling a current flowing to the a light emitting element and electrically connected to the first power supply line, the method of driving the display device includes the following steps, a step of applying a first voltage to a drain of the driving transistor from the first power supply line, while applying an initialization voltage lower than the first voltage to a gate of the driving transistor, a step of applying a voltage higher than the initialization voltage and lower than the first voltage to the drain of the driving transistor, and applying a voltage based on a video signal to the gate of the driving transistor and a step of applying the first voltage to a drain of the driving transistor from the first power supply line and supplying a current to the light emitting element while holding the voltage based on the video signal to the gate of the driving transistor.

A method of driving a display device in an embodiment according to the present invention, the display device includes a plurality of pixels, each of the plurality of pixels includes a light emitting element arranged between a first power supply line applied with a first voltage and a second power supply line applied with a second voltage lower than the first voltage, a driving transistor arranged between the light emitting element and the first power supply line, a source of the driving transistor is electrically connected to the light emitting element, a first switch controlling an electrical connection between a gate of the driving transistor and a signal line supplied with a video signal and an initialization voltage, and a second switch controlling an electrical connection between the first power supply line and a drain of the driving transistor, the method of driving the display device includes the following steps, a step of switching the first switch and the second switch to OFF in a source initialization period and applying a first reset voltage to a drain of the driving transistor, a step of switching the first switch to ON and the second switch to OFF in a gate initialization period following the source initialization period, and applying an initialization voltage higher than the first reset voltage to a gate of the driving transistor from the signal line, a step of switching the first switch and the second switch to ON in an offset cancel period following the gate initialization period, applying an initialization voltage to a gate of the driving transistor, supplying a current to the driving transistor from the first power supply line and shifting a source voltage to a high voltage side, a step of switching the first switch to ON and the second switch to OFF in a video signal writing period following the offset cancel period, applying a video signal to a gate of the driving transistor, and applying a second reset voltage higher than the first reset voltage and lower than a voltage of the first power supply line to a drain of the driving transistor; and a step of switching the first switch to OFF and the second switch to ON in a emission period following the video signal writing period, and supplying a current from the first power supply line to the light emitting element according to a gate voltage of the driving transistor.

A display device in an embodiment according to the present invention includes a plurality of pixels, each of the plurality of pixel includes a first power supply line applied with a first voltage, a light emitting element arranged between the first power supply line applied with the first voltage and a second power supply line applied with a second voltage lower than the first voltage, a driving transistor arranged between the light emitting element and the first power supply line, a source of the driving transistor is electrically connected to the light emitting element, a first switch controlling an electrical connection between a signal line supplied with a video signal and an initialization voltage, and a gate of the driving transistor; and a second switch controlling an electrical connection between the first power supply line and a drain of the driving transistor, the display device further includes, a driving circuit controlling an ON/OFF operation of the first switch and the second switch, applying a video signal and an initialization voltage to the signal line, and applying a first reset voltage and a second voltage to the driving transistor, a source initialization period for switching the first switch and the second switch to OFF, and applying the first reset voltage to a drain of the driving transistor, a gate initialization period following the source initialization period for switching the first switch to ON and the second switch to OFF, and applying an initialization voltage higher than the first reset voltage to a gate of the driving transistor from the signal line, a first offset cancel period following the gate initialization period for switching the first switch and the second switch to ON, applying an initialization voltage to a gate of the driving transistor, supplying a current to the driving transistor from the first power supply line, and shifting a source voltage to a high voltage side, a video signal writing period following the offset cancel period for switching the first switch to ON and the second switch to OFF, applying a video signal voltage to a gate of the driving transistor, and applying the second reset voltage higher than the first reset voltage and lower than a voltage of the first power supply line to a drain of the driving transistor; and a emission period following the video signal writing period for switching the first switch to OFF and the second switch to ON, and supplying a current from the first power supply line to the light emitting element according to a gate voltage of the driving transistor.

DESCRIPTION OF EMBODIMENTS

The embodiments of the present invention are explained below while referring to the diagrams. However, the present invention can be realized by various different forms and should not be interpreted as being limited to the contents described in the embodiments exemplified below. In addition, although the width, thickness and shape of each component are represented schematically compared to actual component in order to better clarify the explanation of the invention, these are merely examples and should not limit an interpretation of the present invention. In addition, in the present specification and each diagram, the same reference symbols are attached to the same elements which have been previously been described and therefore a detailed explanation of such elements may be omitted.

In the present specification, when certain components or regions are described as above (or below) other components or regions, unless specified otherwise, this includes not only being directly above (or directly below) other components or regions, but also above (or below) other components or regions, that is, other structural components may be included there between.

In addition to a period in which a light emitting element emits light and an image is displayed (light emitting period), a display device which displays an image using a light emitting element of a pixel also requires a video signal writing period for writing a video signal to each pixel. In addition, a reset period for initializing a gate voltage and an offset cancel period for compensating a threshold voltage are required for compensating for variation in characteristics in a driving transistor in each pixel.

For example, a voltage in the vicinity of a light emitting operation by a light emitting element is applied to the drain of a driving transistor in an offset cancel period for compensating a threshold voltage of the driving transistor. However, when the number of pixels increases due to increased high definition of a pixel in a display part, an offset cancels period which is to be reduced. In addition, deterioration in transistor characteristics such as the occurrence of a kink phenomenon caused by miniaturization of a driving transistor that comes with high definition of a pixel is a problem that cannot be ignored.

When an offset cancel is insufficiently performed and a threshold voltage of a driving transistor is not sufficiently compensated due to these reasons, the image quality of a display device deteriorates. The display device related to one embodiment of the present embodiment described below can solve these types of problems.

First Embodiment

The display device and method of driving the display device related to one embodiment of the present invention is explained while referring to the diagrams.

Figure 1:
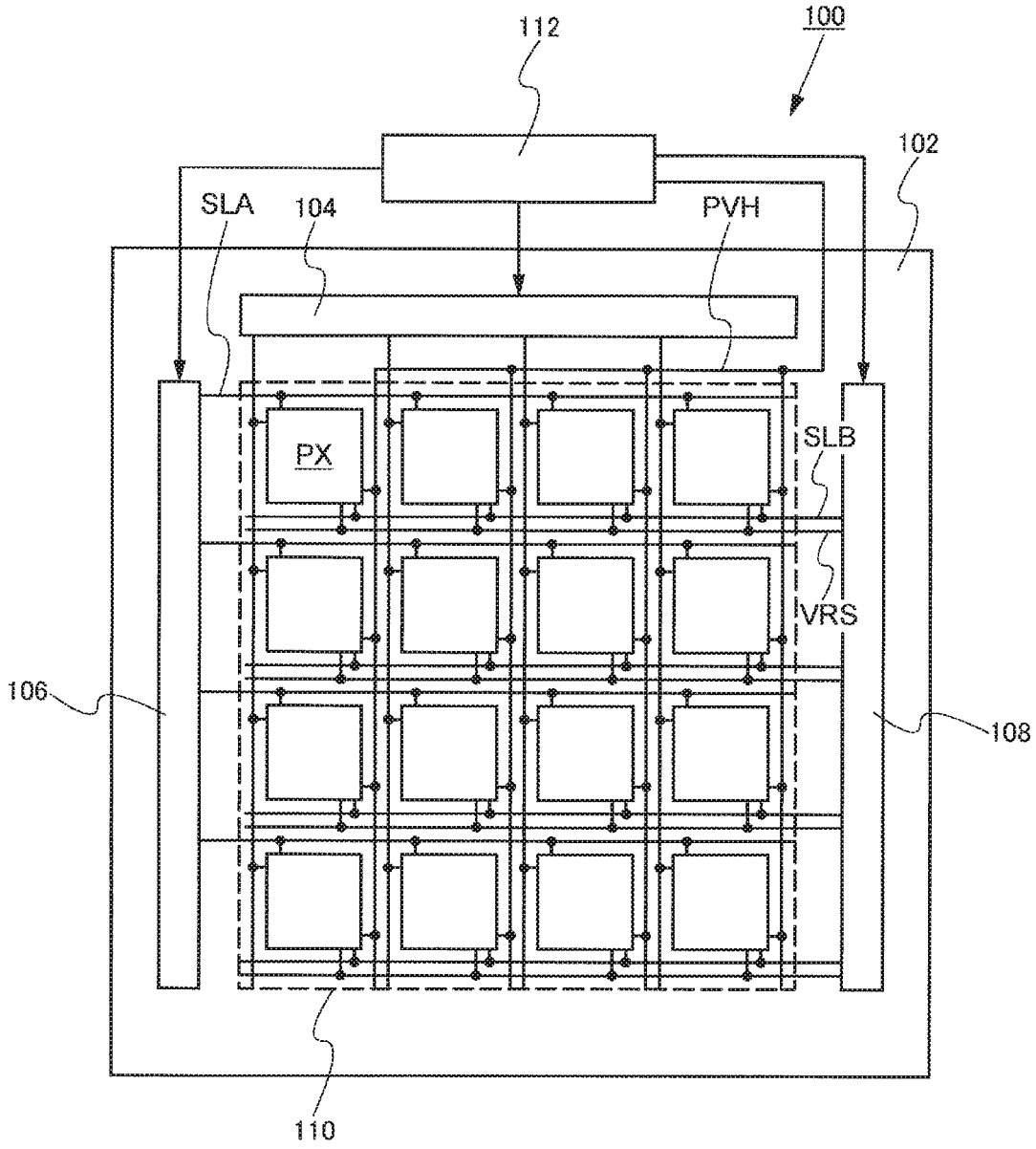
FIG. 1 is a diagram showing a schematic structure of a display device related to one embodiment of the present invention.

Structure of a Display Device:

FIG. 1 shows a schematic diagram of a display device 100 related to one embodiment of the present invention. The display device 100 includes a display panel 102 and a controller 112 which controls the operation of the display panel 102.

The display device 100 includes a display part 110 arranged with a plurality of pixels PX. Although the pixels PX are shown In FIG. 1 arranged 4×4, actually an arbitrary number of pixels PX are arranged in a row direction and column direction. For example, when m number of pixels PX are arranged in a row direction n number of pixels PX are arranged in a column direction, the number of pixels in the display part 110 becomes m×n. Furthermore, although an example in which the pixels PX are shown in a square arrangement in FIG. 1, other arrangement shapes may also be applied such as a delta arrangement.

The display panel 102 is arranged with a driving circuit which is supplied with a signal from the controller 112. FIG. 1 shows a state in which a first driving circuit 104 which drives a first signal line VSL, a second driving circuit 106 which drives a first scanning line SLA, and a third driving circuit 108 which drives a second scanning line SLB and a second signal line VRS are arranged in the display panel 102 as the structure of a driving circuit. In addition, a first power supply line PVH for supplying power to a display element in each pixel PX is arranged in the display panel 102. Furthermore, as long as the driving method related to the present embodiment explained herein can be realized, the structure of the driving circuit is not limited to that shown in FIG. 1 and other structures are possible.

A light emitting element is used as a display element in a pixel PX in the present embodiment. The light emitting element is preferred to be an element which emits light using electroluminescence, for example, an organic electroluminescence element using an organic electroluminescence material in a light emitting layer.

Figure 2:
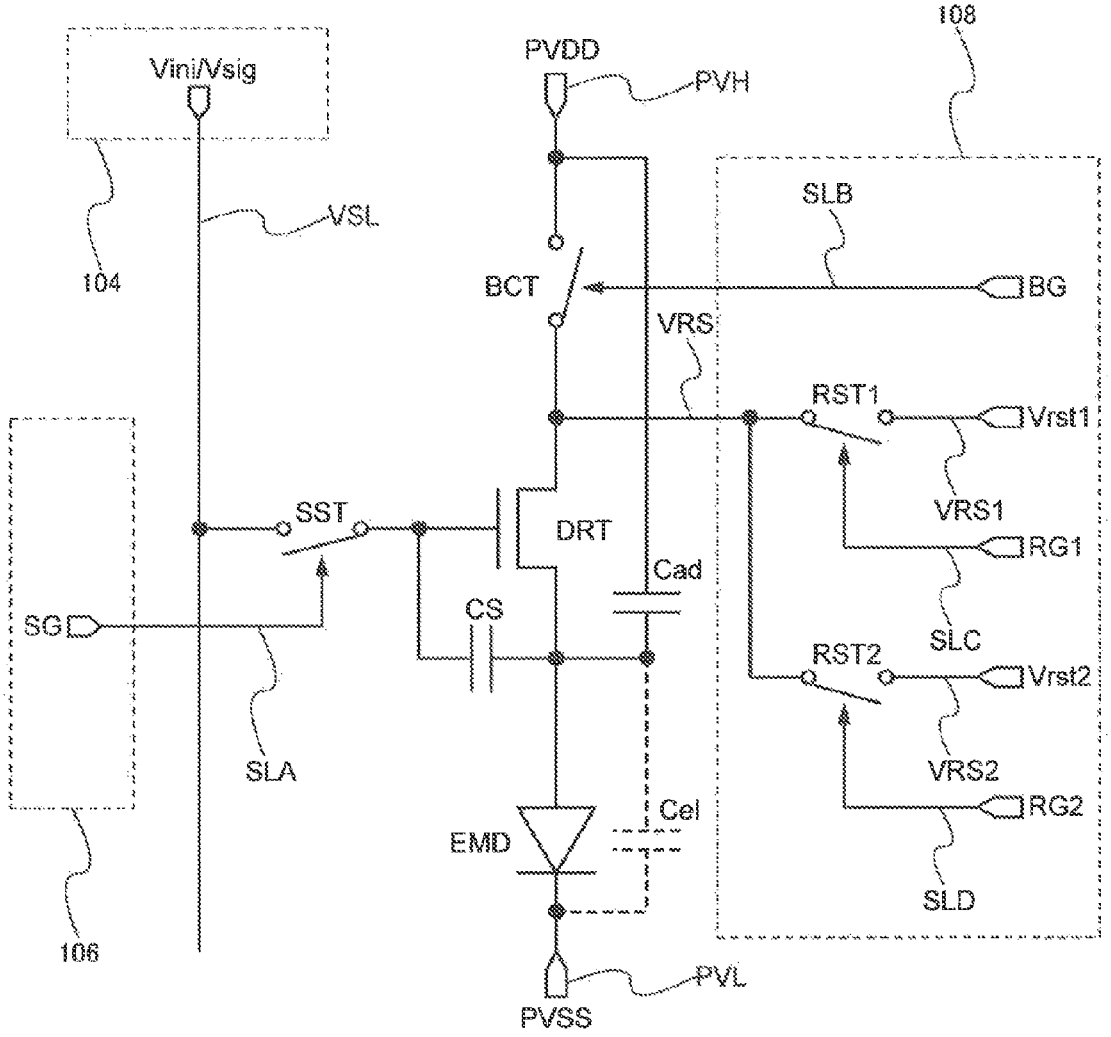
FIG. 2 is a diagram showing an equivalent circuit structure of a pixel in a display device related to one embodiment of the present invention.

Equivalent Circuit of a Pixel:

FIG. 2 shows an equivalent circuit of a pixel PX in the display device 100 related to the present embodiment. A light emitting element EMD is arranged between a first power supply line PVH and a second power supply line PVL. A different voltage is supplied to the first power supply line PVH and a second power supply line PVL. For example, a high voltage PVDD is supplied to the first power supply line PVH and a low voltage PVSS which is lower than the high voltage PVDD is supplied to the second power supply line PVL.

The light emitting element EMD serves as a diode type two-terminal element. The light emitting element EMD is supplied with a voltage above a light emitting threshold voltage between the two terminals and emits light when a forward current flows. The light emitting intensity of the light emitting element EMD changes in proportion to an increase or decrease in the amount of current within the range of actual operation.

The driving transistor DRT can be applied with an insulated gate field effect transistor which includes a gate as a control terminal and a source and drain as input/output terminals. The driving transistor DRT is arranged between the first power supply line PVH and the light emitting element EMD. Specifically, one of the input/output terminals corresponding to the source and drain of the driving transistor DRT is electrically connected to the first power supply line via a second switch BCT. In addition, the other input/output terminal corresponding to the source and drain of the driving transistor DRT is electrically connected to one terminal of the light emitting element EMD.

The gate of the driving transistor DRT is electrically connected to the first signal line VSL via the first switch SST. That is, the first switch SST is arranged between the first signal line VSL and the gate of the driving transistor DRT. The first switch SST controls an ON/OFF operation using a control signal SG (including an amplitude VGH/VGL) which is supplied from the first scanning line SLA. Here, the control signal VGH is a high voltage signal which switches the first switch SST to ON, and the control signal VGL is a low voltage signal which switches the first switch SST to OFF. When the first switch SST is ON, a voltage of the first signal line VSL is supplied to the gate of the driving transistor DRT.

The driving transistor DRT is serially connected with the light emitting element EMD via the second switch BCT between the first power supply line PVH and second power supply line PVL. In the driving transistor DRT, a drain current is controlled by a gate voltage and a current corresponding to the drain current flows to the light emitting element EMD. That is, the intensity of the light emitted by the light emitting element is controlled by the driving transistor DRT.

In the present embodiment, the driving transistor DRT is an n channel type. In the explanation herein, for the sake of convenience, the input/output terminal on the side electrically connected with the first power supply line PH in the driving transistor DRT is the drain, and the input/output terminal on the side electrically connected with the light emitting element EMD is the source.

A capacitance element CS is arranged between the source and gate of the driving transistor DRT. The capacitance element CS holds a voltage between the gate-source of the driving transistor DRT.

An initialization signal Vini and video signal Vsig are supplied alternately to the first signal line VSL. The initialization signal Vini is a signal which supplies an initialization voltage having a constant level. The ON/OFF state of the first switch SST is controlled at certain timing in synchronization with the first signal line VSL, and a voltage is supplied to the gate of the driving transistor DRT based on the initialization signal Vini or video signal Vsig.

A second signal line VRS is electrically connected to the drain of the driving transistor DRT. A first reset voltage Vrst1 and second reset voltage Vrst2 which are different voltages are supplied to the second signal line VRS. The second signal line VRS is arranged with a third switch RST1 and fourth switch RST2 in parallel so that at least two voltages are supplied in a third driving circuit 108. The third switch RST1 selects a connection between the second signal line VRS and the first reset signal line VRS1. The fourth switch RST2 controls a connection between the second signal line VRS and the second reset signal line VRS2. The third switch RST1 and fourth switch RST2 are forbidden to be switch ON at the same time, when one is ON the other is switched OFF.

ON/OFF control of the third switch RST1 is performed by a control signal RG1 (including an amplitude VGH/VGL) of a first control line SLC. ON/OFF control of the fourth switch RST2 is performed by a control signal RG2 (including an amplitude VGH/VGL) of a second control line SLD.

A switching element may be applied for the first switch SST and the second switch BCT. A transistor may be applied as an example of a switching element. When a transistor is used as a switching element, an insulation type field effect transistor may be applied the same as the driving transistor DRT. The first switch SST and the second switch BCT can be realized using an n channel type transistor.

In this way, by providing a transistor arranged in a pixel PX with homopolarity, a p channel type transistor is not required in at least the display part 110. Therefore, a p type impurity region is not required considering the layout of a circuit. It is possible to achieve simplification since counter-doping is not necessary in a manufacturing process.

Furthermore, the third switch RST1 and fourth switch RST2 can similarly be realized using a transistor, for example, an n channel type transistor may be used.

As described above, in the equivalent circuit of the pixel shown in FIG. 2, the gate of the driving transistor DRT is electrically connected to one terminal of the first switch SST, the drain is electrically connected to one terminal of the second switch BCT, and the source is electrically connected to one terminal of the light emitting element EMD. One terminal of the first switch SST is electrically connected to the gate of the driving transistor DRT and the other terminal is electrically connected to the first signal line VSL. One terminal of the second switch BCT is electrically connected to the drain of the driving transistor DRT and the other terminal is electrically connected to the first power supply line PVH. In addition, a capacitance element is electrically connected between the gate and source of the driving transistor DRT. In addition, the second signal line VRS is connected to the drain of the driving transistor DRT. Connection of the second signal line VRS to the first reset signal line RSV1 is controlled by the third switch RST1 and connection to the second reset signal line RSV2 is controlled by the fourth switch RST2.

That is, a pixel PX in the display device 100 related to the present embodiment includes the light emitting element EMD arranged between the first power supply line PVH which is supplied with the first power supply voltage PVDD and the second power supply line PVL which is supplied with the second power supply voltage PVSS which is lower than the first voltage, the driving transistor DRT arranged between the light emitting element EMD and the first power supply line PVH, the source of the driving transistor DRT being electrically connected to one end of the light emitting element EMD, the first switch SST which controls an electrical connection between the first signal line VSL supplied with the initialization signal Vini and video signal Vsig, and the gate of the driving transistor DRT, and the second switch BCT which controls an electrical connection between the first power supply line PVH and the drain of the driving transistor DRT.

The initialization signal Vini and video signal Vsig are supplied to the first signal line VSL. The first reset voltage Vrst1 and second reset voltage Vrst2 are supplied to the second signal line VRS. The second reset voltage Vrst2 is a voltage higher than the first reset voltage Vrst1 and lowers than the voltage PVDD of the first power supply line. In addition, the initialization voltage Vini is preferred to be a voltage higher than the first reset voltage Vrst1 and lower than the second reset voltage Vrst2.

Furthermore, an auxiliary capacitor Cad and capacitor Cel are shown in the equivalent circuit of the pixel shown in FIG. 2. The auxiliary capacitor Cad is an element arranged for adjusting the amount of light emitting current and is sometimes not necessary. The capacitor Cel is a capacitor (parasitic capacitor) of the light emitting element EMD itself. The auxiliary capacitor Cad may be connected between the source of the driving transistor DRT and the first power supply line PVH.

Figure 3:
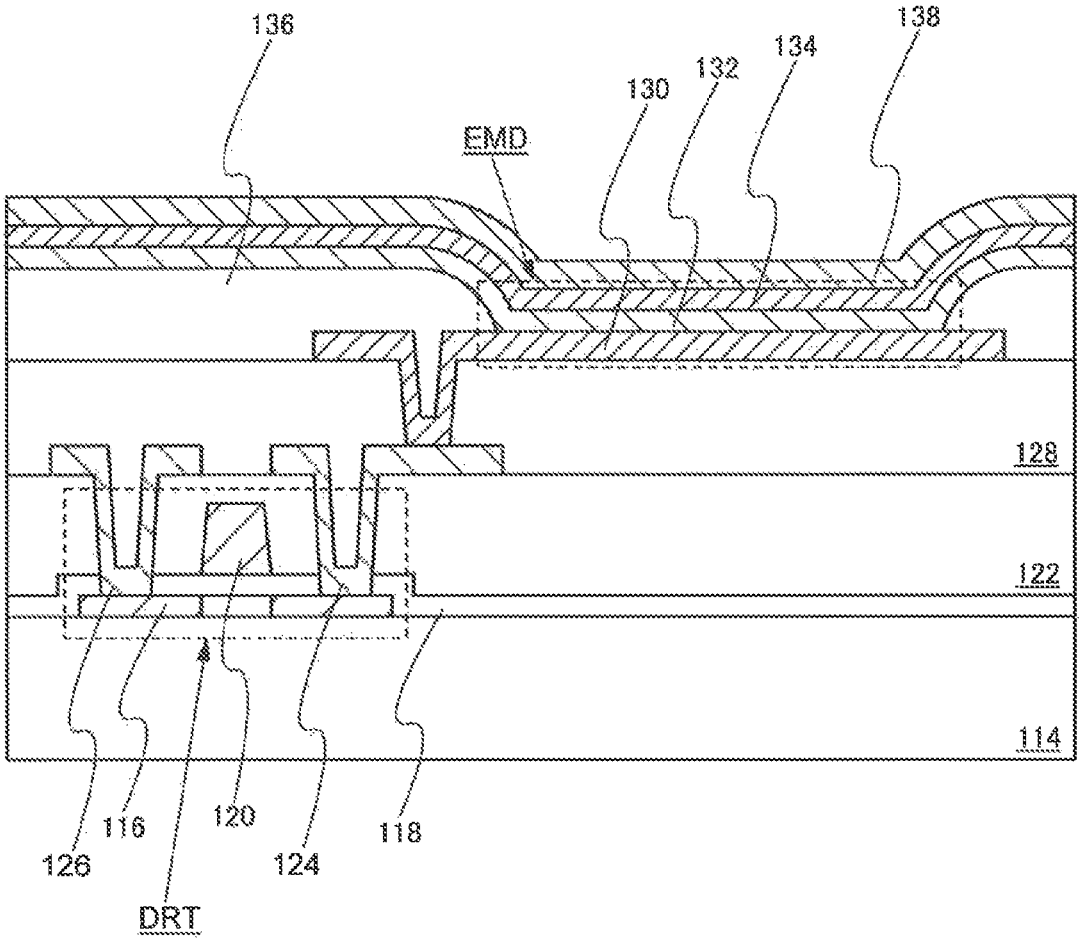
FIG. 3 is a cross sectional diagram showing a structure of a driving transistor and a light emitting element forming a display device related to one embodiment of the present invention.

Next, the structure of the driving transistor DRT and light emitting element EMD which can be applied in one embodiment of the present invention is explained in detail while referring to FIG. 3.

The driving transistor DRT is arranged above a first substrate 114. The driving transistor DRT has a structure including a semiconductor layer 116, gate insulation layer 118 and gate electrode 120. The semiconductor layer 116 of the driving transistor DRT is formed from an amorphous or polycrystalline silicon semiconductor or an oxide semiconductor. The driving transistor DRT is formed with a channel in a region where the semiconductor layer 116 overlaps the gate electrode 120, and a source region and drain region are arranged to sandwich the channel.

The source electrode 124 and drain electrode 126 are arranged sandwiching a first interlayer insulation layer 122. The source electrode 124 and drain electrode 126 are respectively connected to a source region and drain region of the semiconductor layer 116 passing through a contact hole formed in the first interlayer insulation layer 122 and the gate insulation film 118. A second interlayer insulation layer 128 is arranged above the source electrode 124 and drain electrode 126.

The light emitting element EMD includes a pixel electrode 130, a light emitting layer 132 and an opposing electrode 134. In the present embodiment, the pixel electrode 130 is an anode and the opposing electrode 134 is a cathode. A bank layer 136 is arranged to enclose the pixel electrode 130. The light emitting layer 132 is arranged from the pixel electrode 130 to the bank layer 136. The light emitting layer 132 includes a light emitting material such as a low molecular or high molecular organic electroluminescence material. In the case where a low molecular organic material is used as the light emitting material, in addition to a light emitting layer including an organic material with light emitting properties, the light emitting layer 132 may be formed by including a hole injection layer and electron injection layer which sandwich the light emitting layer, and also may include a hole transport layer and electron transport layer. For example, the light emitting layer 132 includes a structure in which a layer including a light emitting material is sandwiched by a hole injection layer and electron injection layer. In addition to a hole injection layer and electron injection layer, a hole transport layer, electron transport layer, hole block layer and electron block layer and the like may also be added to the light emitting layer 132 as appropriate.

Furthermore, in the present embodiment, the light emitting element EMD may also include what is called a top emission type structure in which light emitted by the light emitting layer 132 is emitted to the side of the opposing electrode 132. In this case, since light emitted by the light emitting layer 132 is reflected from the pixel electrode 130 to the side of the of the opposing electrode 132, it is preferred that the pixel electrode 130 is formed from a metal film with high reflectance or a stacked layer film including such a metal film. Atop emission type pixel emits light from a surface on the opposite side to the surface on the side where a transistor and the like of a pixel circuit of the light emitting element EMD is arranged. As a result, it is possible to form a pixel with a high aperture ratio without being affected by the arrangement of a transistor and the like provided in a pixel.

In the case where the light emitting layer 132 is stacked with a hole injection layer, light emitting layer and electron injection layer in this order, it is preferred that ITO (Indium Tin Oxide) which has excellent hole injection properties is used in the pixel electrode 130. ITO is a type of conductive material with translucency and while it has high transparency in the visible light band, it also has extremely low reflectance. As a result, a stacked structure of a translucent conductive film and light reflecting film represented by ITO or IZO (Indium Zinc Oxide) may be applied to the pixel electrode 130 in order to provide a function for reflecting light. The light reflecting film is preferred to be formed using aluminum (Al) or silver (Ag) or aluminum (Al) or silver (Ag) alloy material or compound material. For example, an alloy material or compound material in which a few atomic percent of titanium (Ti) is added to aluminum (Al) may be used as the light reflecting film. Since these metal materials have high reflectance with respect to light in the visible light band, it is possible to increase the amount of reflected light irradiated to the pixel electrode 130 from the light emitting layer 132. Furthermore, the light reflecting film is not limited to these metals, titanium (Ti), nickel (Ni), molybdenum (Mo) or chrome (Cr) and the like may also be used in addition to the metal materials previously described.

A sealing layer 138 is arranged on an upper layer of the light emitting element EMD. Although there is no limitation to the sealing layer 138, the sealing layer 138 may be formed from a stacked layer of an insulation layer formed from an inorganic insulation material and an insulation layer formed from an organic resin material. The sealing layer 138 covers the light emitting element EMD and is arranged to prevent the infiltration of water and the like. In the case of a top emission type structure such as that shown in FIG. 3, it is preferred that the sealing layer 138 includes translucency using a cover film such as silicon nitride or aluminum oxide. In addition, a second substrate maybe arranged on an upper part of the sealing layer 138 and a filler material maybe provided there between.

Operation of the Display Device:

Next, the operation of the pixel circuit shown in FIG. 2 is explained. The operation of the pixel circuit related to the present embodiment includes a signal writing period (signal writing operation) and a light emitting period (light emitting operation). The signal writing period further includes a source initialization period, a gate initialization period, an offset cancel period, and a video signal writing period (including a mobility cancel period).

Figure 4:
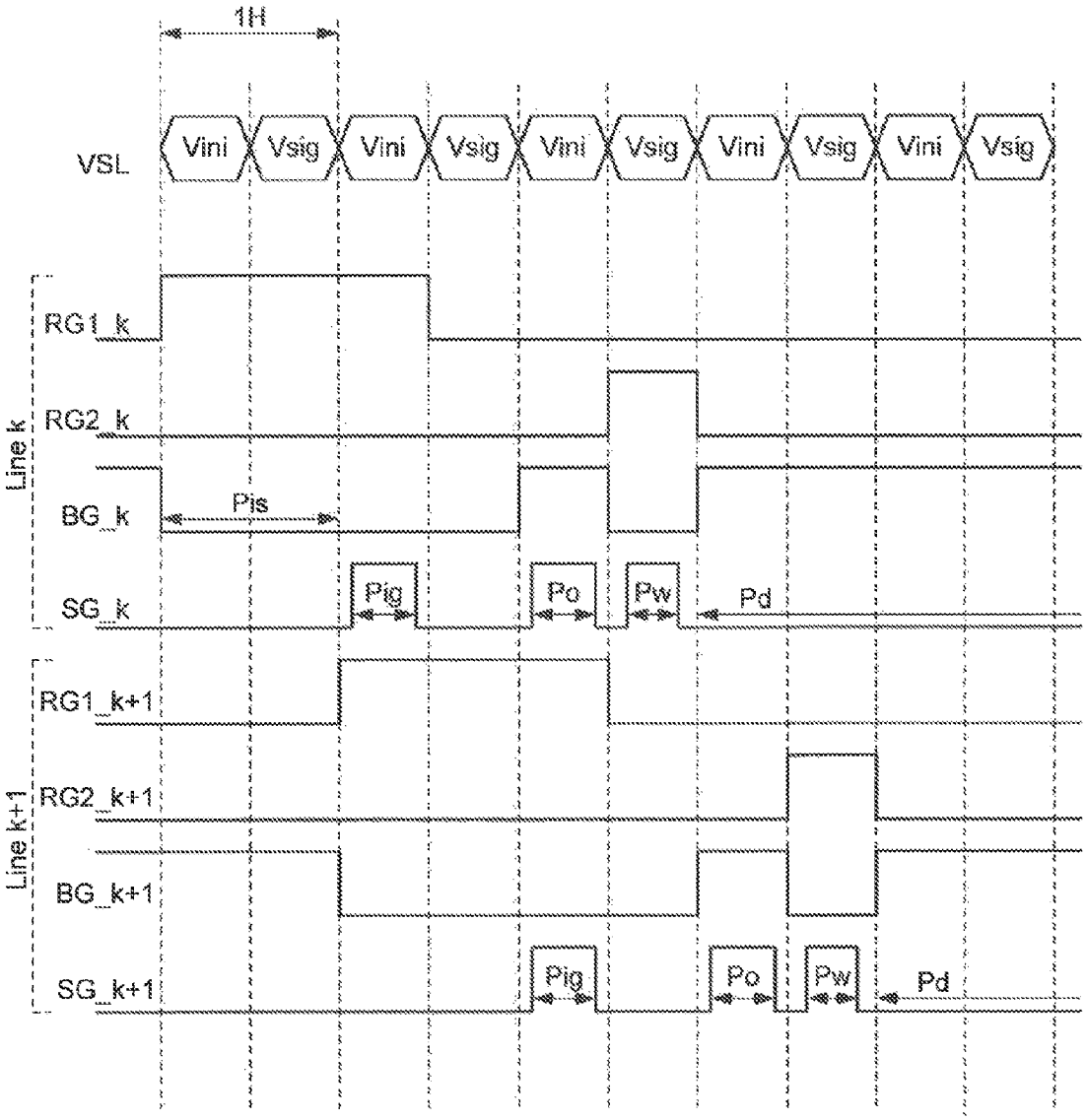
FIG. 4 is a timing chart for explaining an operation of a display device related to one embodiment of the present invention.

FIG. 4 shows a timing chart for explaining the operation of the pixel circuit related to the present embodiment. In FIG. 4, the period labelled 1H corresponds to a 1 line period (1 horizontal period). The operation of a kth row and k+1 row which is the next row in the display part 110 is shown in FIG. 4.

Figure 5A:
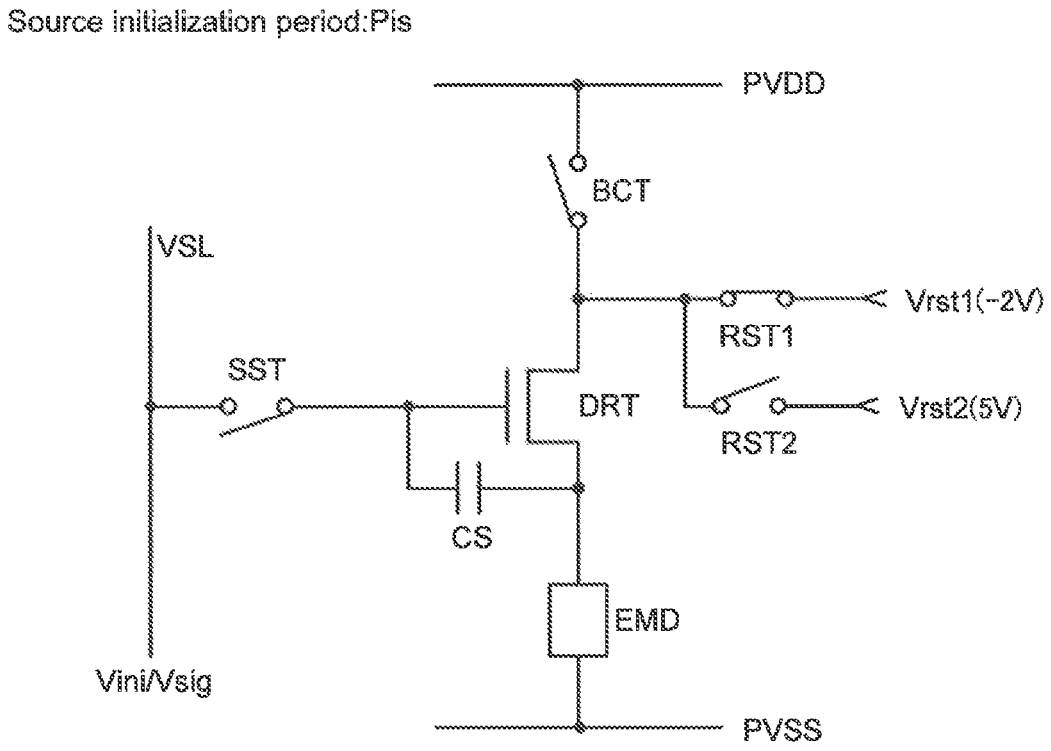
FIG. 5A is an equivalent circuit diagram for explaining an operation of a pixel circuit in a source initialization period in a display device related to one embodiment of the present invention.

A source initialization period Pis is provided as a first period of the signal writing period. The state of a pixel belonging to a kth row at this time is shown in FIG. 5A. In the operation of a pixel circuit in the source initialization period in a kth row, a control signal SG_k of a first scanning line SLA is set to a level (low level voltage VGL) which switches a first switch SST to OFF, a control signal BG_k of a second scanning line SLB is set to a level (low level voltage VGL) which switches a second switch BCT to OFF, a control signal RG1_*k* of a first control line SLC is set to a level (high level voltage VGH) which switches a third switch RST1 to ON, and a control signal RG2_*k* of a second control line SLD is set to a level (low level voltage VGL) which switches a fourth switch RST2 to OFF.

A source initialization operation begins when the first switch SST and second switch BCT are each in an OFF state (non-conducting state), or when the first switch SST is in an ON state (conducting state) and the second switch BCT is in an OFF state (non-conducting state). By setting the third switch RST1 to ON, the drain of the driving transistor DRT is connected to the first reset signal line VRS1. In this way, the source and drain of the driving transistor DRT are reset to the same voltage as the first reset voltage (reset voltage Vrst1), and the source initialization operation is carried out. Here, the first reset voltage Vrst1 is set to −2V for example.

Figure 5B:
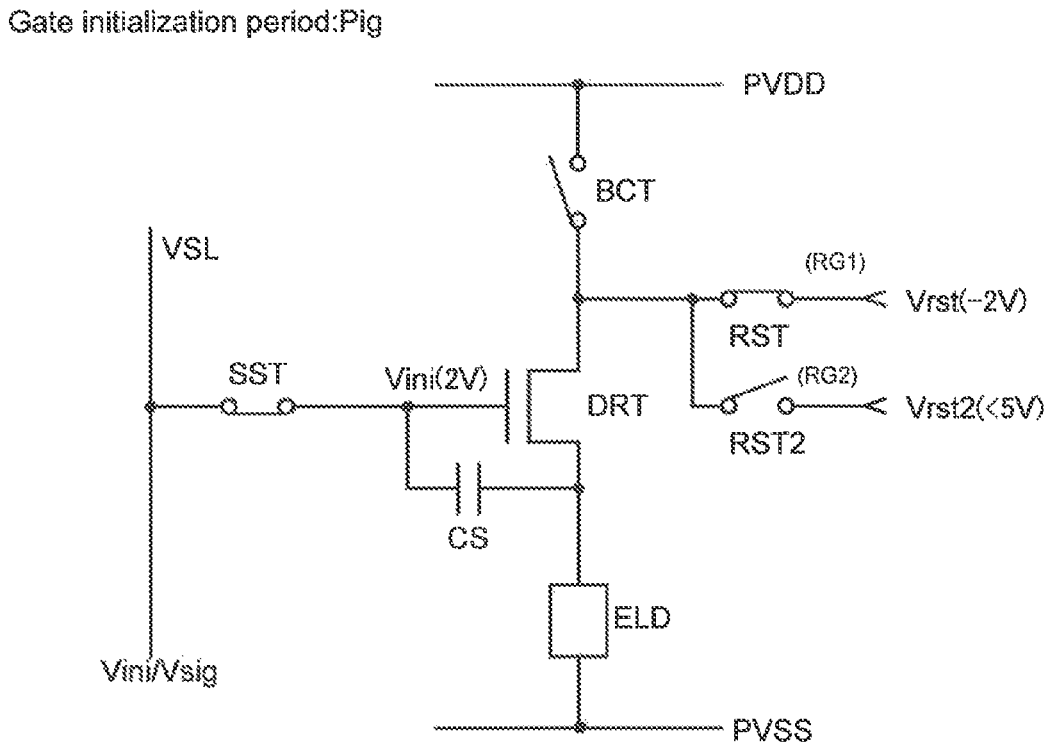
FIG. 5B is an equivalent circuit diagram for explaining an operation of a pixel circuit in a gate initialization period in a display device related to one embodiment of the present invention.

After the source initialization period, the gate initialization period Pig (gate initialization operation) begins. The state of a pixel belonging to the kth row at this time is shown in FIG. 5B. In a kth row in the gate initialization period Pig, the control signal SG_k of the first scanning line SLA is set to a level (high level voltage VGH) which switches the first switch SST to ON, the control signal BG_k of the second scanning line SLB is set to a level (low level voltage VGL) which switches the second switch BCT to OFF, the control signal RG1_*k* of the first control line SLC is set to a level (high level voltage VGH) which switches the third switch RST1 to ON, and the control signal RG2_*k* of the second control line SLD is set to a level (low level voltage VGL) which switches the fourth switch to OFF. The gate initialization operation begins when the first switch SST and the third switch RST1 are ON, and the second switch BCT and fourth switch RST2 are OFF.

In the gate initialization period Pig, the initialization signal Vini (initialization voltage) output from the first signal line VSL passes through the first switch SST and is applied to the gate of the driving transistor DRT. In this way, the voltage of the gate of the driving transistor DRT is reset to a voltage corresponding to the initialization signal Vini and data of the previous frame is initialized. The voltage level of the initialization signal Vini is set to 2V for example.

Figure 6A:
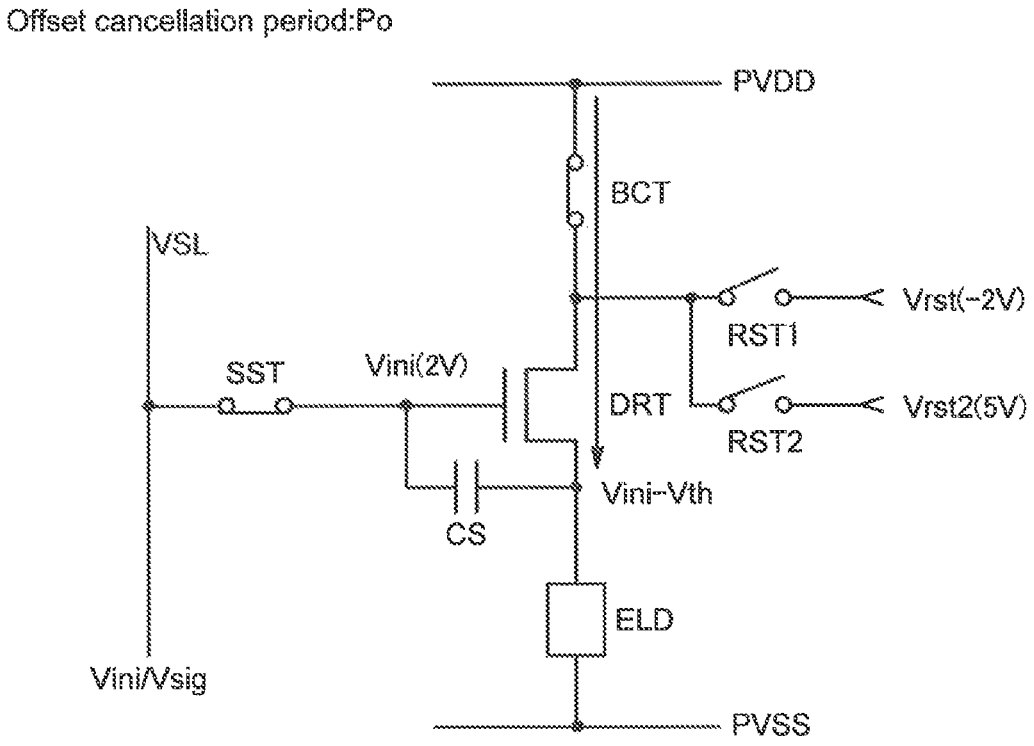
FIG. 6A is an equivalent circuit diagram for explaining an operation in a gate initialization period in a display device related to one embodiment of the present invention.

Next, the process moves to an offset cancel period Po. The state of a pixel belonging to a kth row at this time is shown in FIG. 6A. In a kth row in the offset cancel operation, the control signal SG_k of the first scanning line SLA is set to a level (high level voltage VGH) which switches the first switch SST to ON, the control signal BG_k of the second scanning line SLB is set to a level (low level voltage VGL) which switches the second switch BCT to ON, the control signal RG1_*k* of the first control line SLC is set to a level (low level voltage VGL) which switches the third switch RST1 to OFF, and the control signal RG2_*k* of the second control line is set to a level (low level voltage VGL) which switches the fourth switch RST2 to OFF. In this way, the offset cancel operation begins when the third switch RST1 and fourth switch RST2 are OFF and the first switch SST and second switch BCT are ON.

In the offset cancel period Po, the initialization signal Vini is supplied to the gate of the driving transistor DRT via the first signal line VSL and first switch SST and the voltage of the gate of the driving transistor DRT is fixed.

In addition, the second switch BCT is switched ON and a current flows into the driving transistor DRT from the first power supply line PVH. The voltage (first reset voltage Vrst1) written in the source initialization period Pis is set to an initial value, and the voltage of the source of the driving transistor DRT shifts to a high voltage side so as to compensate for variation in transistor characteristics of the driving transistor DRT while gradually decreasing the current passing between the drain and source of the driving transistor DRT. At this time, since the first power supply line PVH is a high voltage PVDD, the amount of current flowing to the driving transistor DRT becomes a sufficiently large value. Therefore, the current passing between the drain and source of the driving transistor DRT is reduced in a comparatively short period of time. In the present embodiment, the offset cancel period Po is set to a time of around 1 μsec for example.

The voltage of the source of the driving transistor DRT becomes Vini−Vth at the point where the offset cancel period Po finishes. Furthermore, Vth is a threshold voltage of the driving transistor DRT. In this way, the voltage between the gate and source of the driving transistor DRT reaches the threshold voltage Vth of the driving transistor DRT and a voltage difference corresponding to this threshold voltage Vth accumulates (stored) in the capacitor element CS.

Figure 6B:
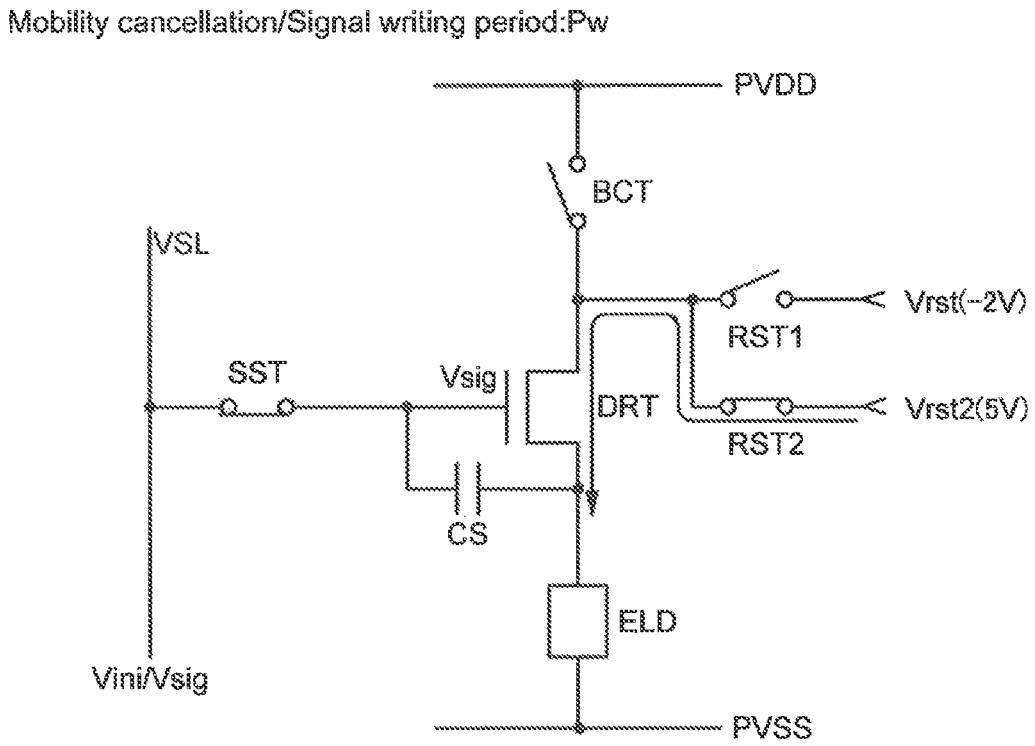
FIG. 6B is an equivalent circuit diagram for explaining an operation in a mobility cancel/signal writing period in a display device related to one embodiment of the present invention.

Next, a video signal writing period Pw begins. The state of a pixel belonging to a kth row at this time is shown in FIG. 6B. In a kth row in the video signal writing period Pw, the control signal SG_k of the first scanning line SLA is set to a level (high level voltage VGH) which switches the first switch SST to ON, the control signal BG_k of the second scanning line SLB is set to a level (high level voltage VGH) which switches the second switch BCT to ON, the control signal RG1_*k* of the first control line SLC is set to a level (low level voltage VGL) which switches the third switch RST1 to OFF, and the control signal RG2_*k* of the second control line is set to a level (high level voltage VGH) which switches the fourth switch RST2 to ON. That is, the video signal writing operation begins when the first switch SST and fourth switch RST2 are ON and the second switch BCT and third switch RST1 are OFF.

In the video signal writing period Pw, the video signal Vsig passes through the first switch SST from the first signal line VSL and is applied to the gate electrode of the driving transistor DRT. In addition, the second reset voltage Vrst2 is supplied to the drain of the driving transistor DRT via the second reset signal line VRS2 and fourth switch RST2. In this way, a current flows between the drain and source of the driving transistor DRT and to the second power supply line PVL via the capacitor part (parasitic capacitance) Cel of the light emitting element EMD. From the operations up to this point, the video signal Vsig and a voltage based on the threshold voltage obtained during the offset cancel operation are written to the gate of the driving transistor DRT and the variation in the mobility of the driving transistor DRT is compensated for. Furthermore, the second reset voltage Vrst2 is higher than the first reset voltage Vrat1 and is lower than the voltage PVDD of the first power supply line PVH. The second reset voltage Vst2, for example, 5V is applied to 5V.

Figure 7:
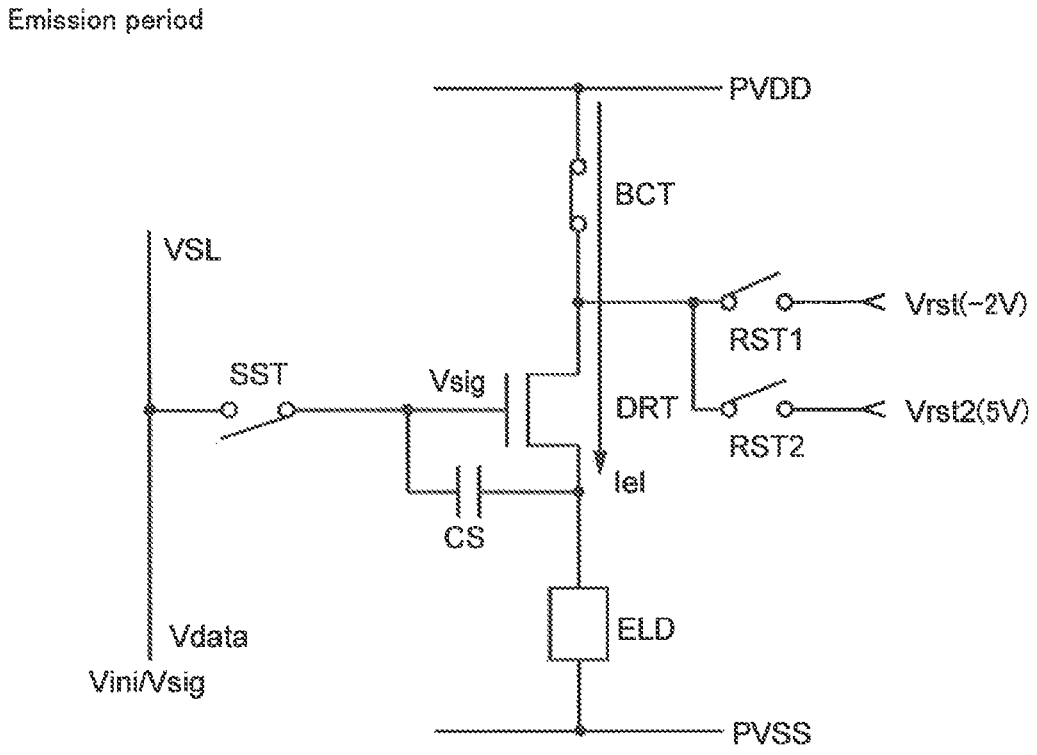
FIG. 7 is an equivalent circuit diagram for explaining a light emitting period operation in a display device related to one embodiment of the present invention.

Lastly, the light emitting period Pd begins. The state of a pixel belonging to the kth row at the time is shown in FIG. 7. In the light emitting period Pd, the control signal SG_k of the first scanning line SLA is set to a level (low level voltage VGL) which switches the first switch SST to OFF, the control signal BG_k of the second scanning line SLB is set to a level (high level voltage VGH) which switches the second switch BCT to ON, the control signal RG1_*k* of the first control line SLC is set to a level (low level voltage VGL) which switches the third switch RST1 to OFF, and the control signal RG2_*k* of the second control line is set to a level (low level voltage VGL) which switches the fourth switch RST2 to OFF. The light emitting operation begins when the second switch BCT is ON, the first switch SST, the third switch RST1 and fourth switch RST2 are OFF.

The driving transistor DRT outputs a drain current Ie of a current amount corresponding to the gate control voltage written to the capacitor element CS. This drain current Ie is supplied to the light emitting element EMD. In this way, the light emitting element EMD emits light at a luminosity according to the drain current Ie and a display operation is performed. After a period of 1 frame, the light emitting element EMD maintains the light emitting state until the second switch BCT becomes an OFF voltage.

The source initialization operation, gate initialization operation, offset cancel operation, video signal writing operation and display operation described above are repeatedly performed in sequence on each pixel PX from the kth row and thereby a desired image is displayed.

According to the driving method shown in FIG. 4, it is possible to apply a sufficient voltage between a drain and source while to apply the initialization voltage Vini to the gate of the driving transistor DRT in the offset cancel period Po and applying a high voltage PVDD from the power supply line PVH to the drain of the driving transistor DRT. In this way, it is possible to saturate an excessive current flowing between the drain and source of the driving transistor DRT in a comparatively short period of time and saturate a source voltage using Vini−Vth. That is, according to the present embodiment, it is possible to reduce the amount of time required for an offset cancel operation (compensate for a threshold voltage) of the driving transistor DRT.

Second Embodiment

An offset cancel period may be arranged several times in the display device 100 shown in the first embodiment. That is, by repeating an offset cancel operation several times in the driving method of the display device 100, it is possible to better compensate for any variation in characteristics caused by a threshold voltage of the driving transistor DRT. A driving method related to the present embodiment is explained below while referring to a timing chart.

Figure 8:
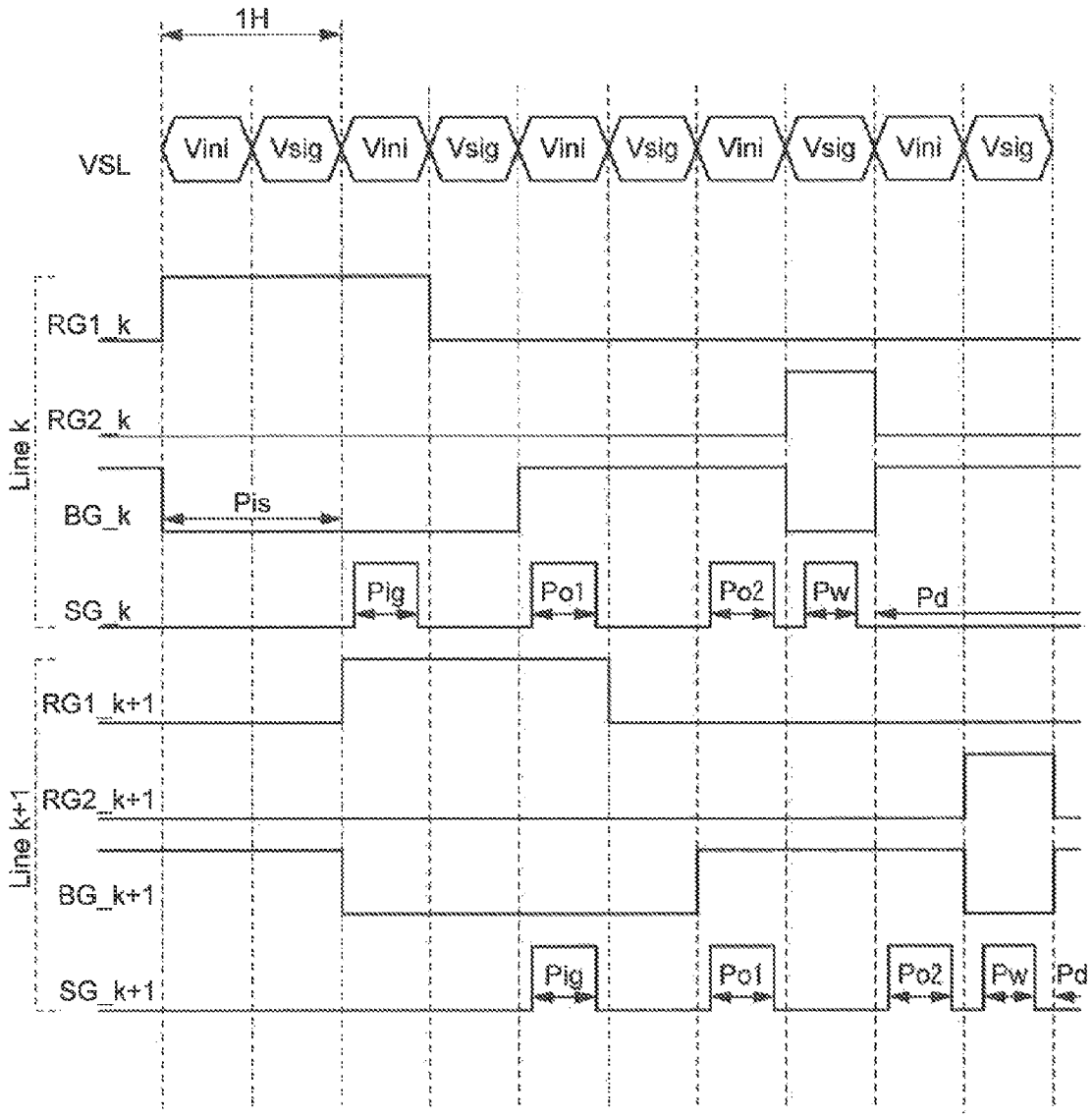
FIG. 8 is a timing chart for explaining an operation of a display device related to one embodiment of the present invention.

Operation of a Display Device:

FIG. 8 shows a timing chart for explaining the operation of a pixel circuit related to the present embodiment. The operation of the kth row and k+1 row which is the next row of the display device 100 is shown in FIG. 8.

In FIG. 8, the operation of the pixel circuit in the source initialization period Pis and gate initialization period Pig is the same as that in the first embodiment.

After the gate initialization period Pig, on the kth row in a first offset cancel period Po1, the control signal SG_k of the first scanning line SLA is set to a level (high level voltage VGH) which switches the first switch SST to ON, the control signal BG_k of the second scanning line SLB is set to a level (high level voltage VGH) which switches the second switch BCT to ON, the control signal RG1_*k* of the first control line SLC is set to a level (low level voltage VGL) which switches the third switch RST1 to OFF, and the control signal RG2_*k* of the second control line is set to a level (low level voltage VGL) which switches the fourth switch RST2 to OFF. In this way, the offset cancel operation begins when the third switch RST1 and fourth switch RST2 are OFF and the first switch SST and second switch BCT are ON.

In the offset cancel period Po1, the initialization signal Vini is supplied to the gate of the driving transistor DRT via the first signal line VSL and first switch SST and the voltage of the gate of the driving transistor DRT is fixed. In addition, the second switch BCT is switched ON and a current flows into the driving transistor DRT from the first power supply line PVH. The first reset voltage Vrst1 is set to an initial value, and the voltage of the source of the driving transistor DRT shifts to a high voltage side so as to compensate for variation in transistor characteristics of the driving transistor DRT while gradually decreasing the current passing between the drain and source of the driving transistor DRT.

The first offset cancel period Po1 ends within the period when the initialization voltage Vini is supplied to the first signal line VSL. That is, the control signal SG_k of the first scanning line SLA changes to a voltage (low level voltage VGL) which switches the first switch SST to OFF. Since the second switch BCT is maintained in an ON state, a high voltage PVDD is applied from the first power source line PVH to the drain of the driving transistor DRT. If the gate voltage of the driving transistor DRT maintains an initialization voltage Vini, an offset cancel operation is also essentially performed in this period.

In the second offset cancel period Po2 which appears after the first offset cancel period Po1, a voltage (high level voltage VGH) is again applied at which the control signal SG_k of the first scanning line sets the first switch SST to ON in a period during which the initialization voltage Vini is supplied to the first signal line VSL. In this way, the initialization voltage Vini is applied from the first signal line VSL to the gate of the driving transistor DRT via the first switch SST.

The initialization voltage Vini is supplied to the gate of the driving transistor DRT via the first signal line VSL and first switch SST and the voltage of the gate of the driving transistor DRT are fixed. In addition, the second switch BCT is in an ON state and a high voltage PVDD is applied to the driving transistor DRT from the first power supply line PVH. That is, the same operation as the first offset cancel period Po1 is repeated. In the case where the source voltage of the driving transistor DRT is not sufficiently saturated in the first offset cancel period, a current flows between the drain and source of the driving transistor DRT. In this way, the source voltage of the driving transistor DRT shifts to a high voltage side so as to compensate for variation in transistor characteristics of the driving transistor DRT.

After the second offset cancels period, the operations of the video signal writing period Pw and the light emitting period Pd are the same as in the first embodiment.

Although a form in which the second offset cancel period Po2 is performed after the first offset cancel period Po1 is shown in FIG. 8, the offset cancel period is not limited to two times. That is, the offset cancel operation may be performed several times. In either case, by arranging an offset cancel period several times within a signal writing period, it is possible to better saturate the source voltage of the driving transistor DRT using Vini−Vth. That is, according to the present embodiment, it is possible to better compensate for variations in characteristics caused by a threshold voltage of a driving transistor while continuing to reduce the time required for an offset cancel operation

Third Embodiment

In the case where several offset cancel periods arranged, the voltage which is applied to the drain side of the driving transistor DRT may be made different between at least one offset cancel period and another offset cancel period.

Figure 9:
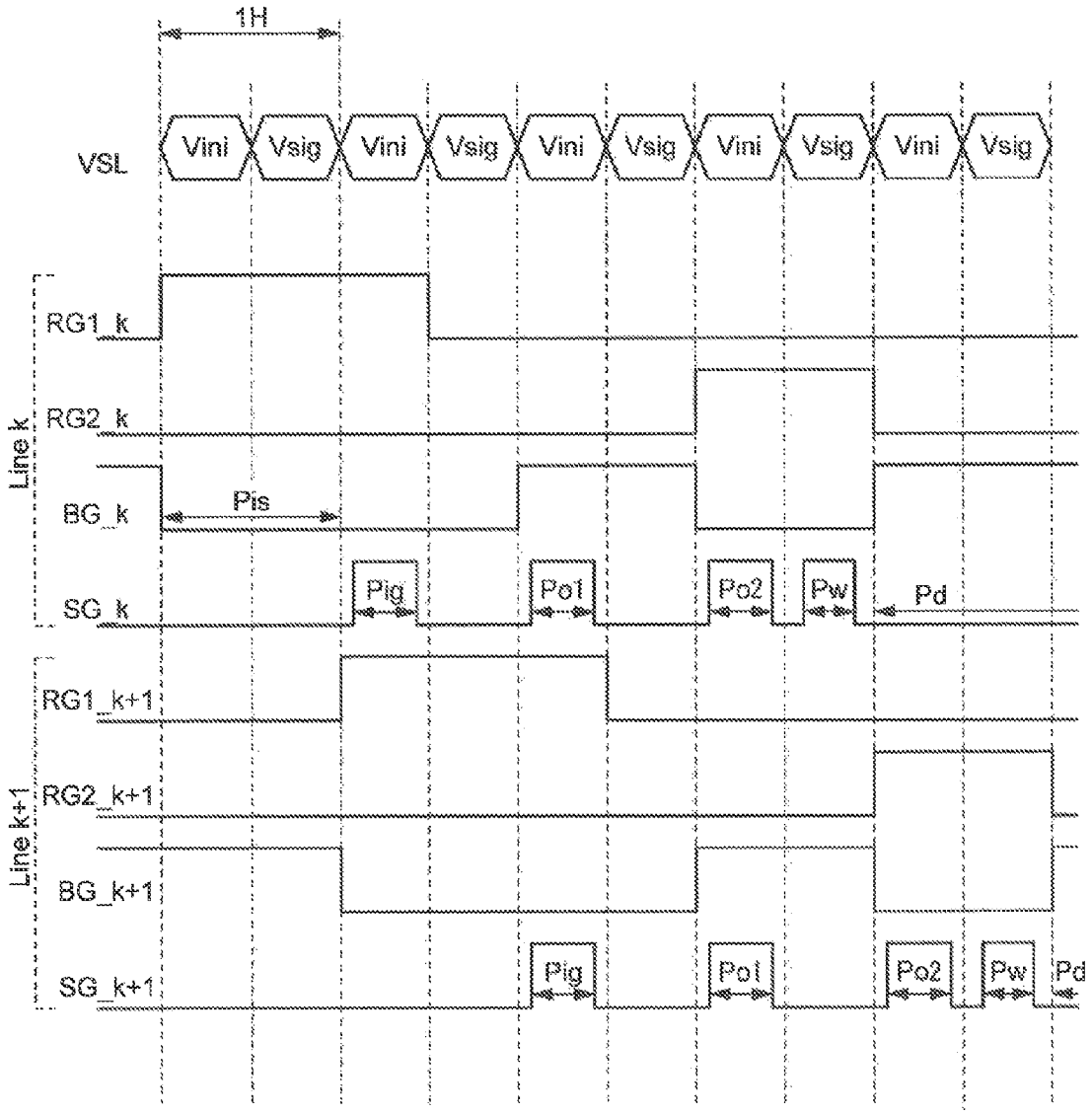
FIG. 9 is a timing chart for explaining an operation of a display device related to one embodiment of the present invention.

Operation of a Display Device:

FIG. 9 shows a first offset cancel period and a second offset cancel period and timing chart in the case where a voltage applied to the drain of the driving transistor DRT is made different in each of the offset cancel periods respectively.

In FIG. 9, a pixel circuit operates the same as the pixel circuit shown in FIG. 8 in a source initialization period Pis, gate initialization period Pig and first offset cancel period Po1. That is, in the first offset cancel period Po1, the first switch SST is in an ON state, an initialization voltage Vini is supplied to the gate of the driving transistor DRT from the first power supply line PVH, the second switch BCT is switched ON, and it is possible for a current to flow into the driving transistor DRT from the first power supply line PVH. At this time, the third switch RST1 and fourth switch RST2 are in an OFF state.

The first offset cancel period Po1 ends when the control signal SG_k of the first scanning lie SLA becomes a voltage level (low level voltage VGL) which switches the first switch SST to OFF.

After the first offset cancel period Po1, in the second offset cancel period Po2, while an initialization voltage Vini is supplied to the first signal line VSL, the control signal SG_k of the first scanning line SLA becomes a voltage level (high level voltage VGH) which switches the first switch SST to ON, the control signal BG_k of the second scanning line SLB becomes a voltage level (low level voltage VGL) which switches the second switch BCT to OFF, and the control signal RG2_*k* of the second control line SLD changes to a voltage level (high level voltage VGH) which switches the fourth switch RST2 to ON.

Figure 10A:
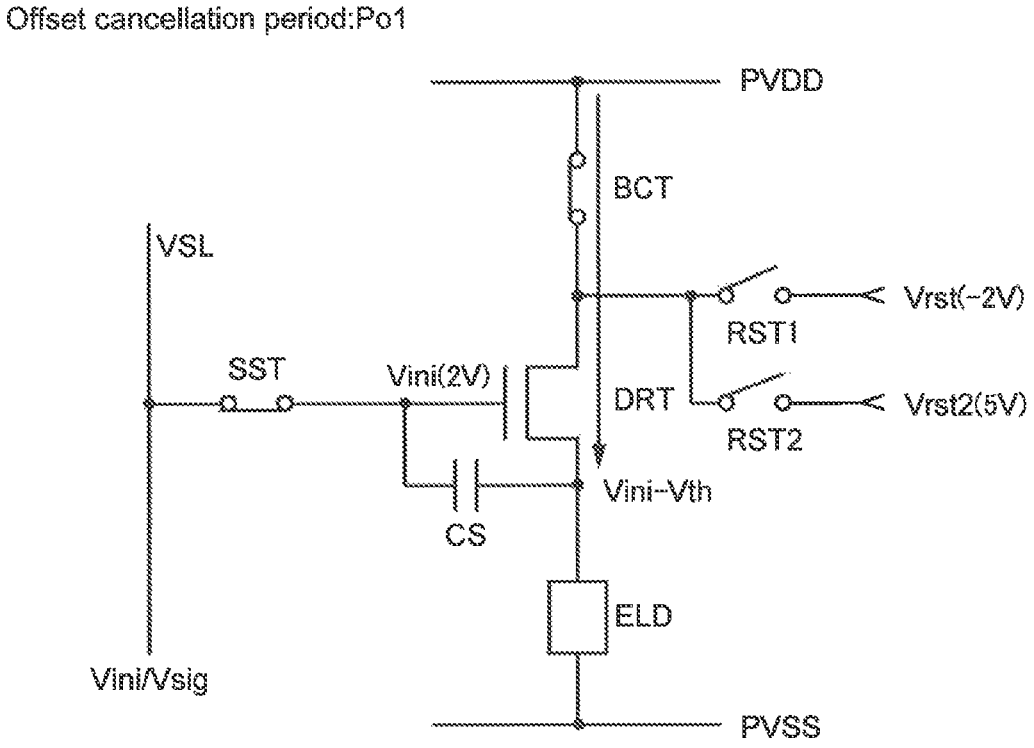
FIG. 10A is an equivalent circuit diagram for explaining an operation in an offset cancel period in a display device related to one embodiment of the present invention.
Figure 10B:
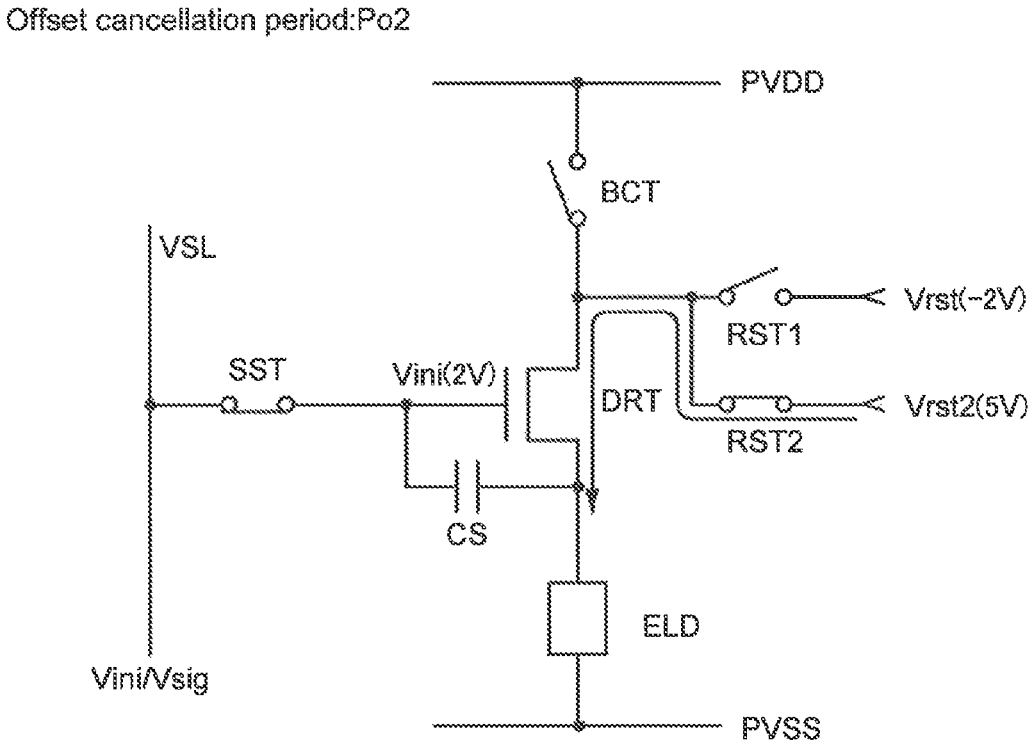
FIG. 10B is an equivalent circuit diagram for explaining an operation in an offset cancel period in a display device related to one embodiment of the present invention.

In this way, as is shown in FIG. 10B, the first switch SST is switched to ON, the initialization voltage Vini is supplied to the gate of the driving transistor DRT from the first signal line VSL, the second switch BCT and third switch RST1 are switched to OFF, the fourth switch is switched to ON, and the second reset voltage Vrst2 is applied to the drain of the driving transistor DRT from the second reset signal line VRS2.

When the initialization voltage Vini is supplied to the gate and the second reset voltage Vrst2 is supplied to the drain of the driving transistor DRT, a current continues to flow until a source voltage reaches Vini−Vth. That is, the source voltage of the driving transistor DRT shifts to a high voltage side from a source voltage of the driving transistor after the first offset cancel period Po1 has elapsed in order to compensate for any variation in transistor characteristics of the driving transistor DRT while further gradually reducing the current component flowing between the drain and source using the second reset voltage Vrst2.

The second reset voltage Vrst2 is a lower voltage than the high voltage PVDD supplied to the first power supply line PVH. Therefore, when comparing using the same state, the time until an excessive current flowing between a drain and source is saturated becomes longer by reducing an applied voltage when the second reset voltage Vrst2 is applied compared to when the high voltage PVDD is applied to the drain of the driving transistor DRT. However, according to the driving method show in FIG. 9, since a high voltage PVDD is applied to the drain of the driving transistor DRT in the first offset cancel period Po1 and the source voltage increases, the source voltage is precisely controlled by applying the second reset voltage Vrst2 in the subsequent second offset cancel period Po2 and it is possible to compensate for any variation in transistor characteristics.

Figure 13:
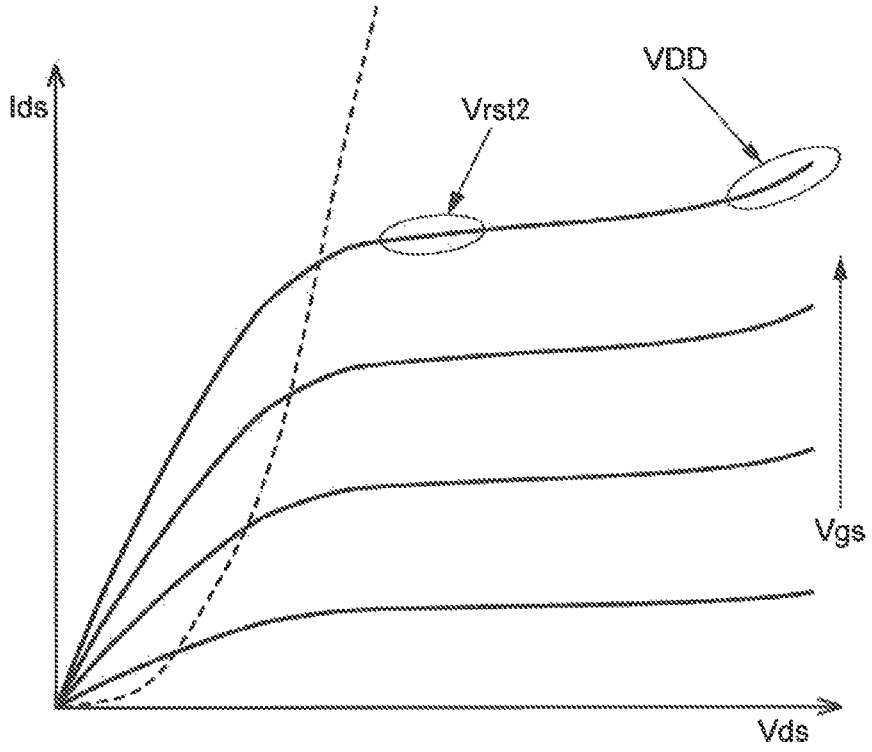
FIG. 13 is a schematic diagram for explaining the characteristics of a drain voltage Vds with respect to a drain current Ids of a transistor.

FIG. 13 shows an example of the characteristics of a drain voltage Vds with respect to a drain current Ids of a transistor. For example, in the case where a high voltage such as the voltage PVDD of the first power supply line is applied as the drain voltage Vds, the drain current Ids increases with a certain incline even in a saturation region in which the current should be constant with respect to a change in the original Vds due to the influence of a kink effect. On the other hand, in the case where the second reset voltage Vrst2 is applied as a voltage in the vicinity of an operation point of a light emitting element, since the influence of a kink effect on the drain current Ids is small compared to the case where a high voltage PVDD is applied, the ideal characteristics of a saturation region are almost achieved. According to the present embodiment, it is possible to make a voltage applied to the drain of the driving transistor DRT different between the initial and latter periods of an offset cancel operation.

According to the present embodiment, by making a voltage applied to a drain of a driving transistor different between a first offset cancel period Po1 and second offset cancel period Po2, it is possible to precisely perform compensation of a threshold voltage of a driving transistor while continuing to achieve a reduction in the time required for an offset cancel operation.

Furthermore, although FIG. 9 shows the case where the first offset cancel period and second offset cancel period are each performed once, the present embodiment is not limited to this. For example, the first offset cancel period Po1 may be performed several times. In this way, it is possible to better perform an offset cancel operation of a driving transistor. In addition, the second offset cancel period Po2 may also be performed several times. In this way, it is possible to more precisely perform an offset cancel operation of a driving transistor.

Fourth Embodiment

In the present embodiment, the structure of a display part shows an example of a display device with a different form to that shown in FIG. 2. In the display device 100*b* related to the present embodiment, a second switch is shared among a plurality of pixels in a display part 110*b*. The form of this type of display device 100*b* is shown in FIG. 11.

Figure 11:
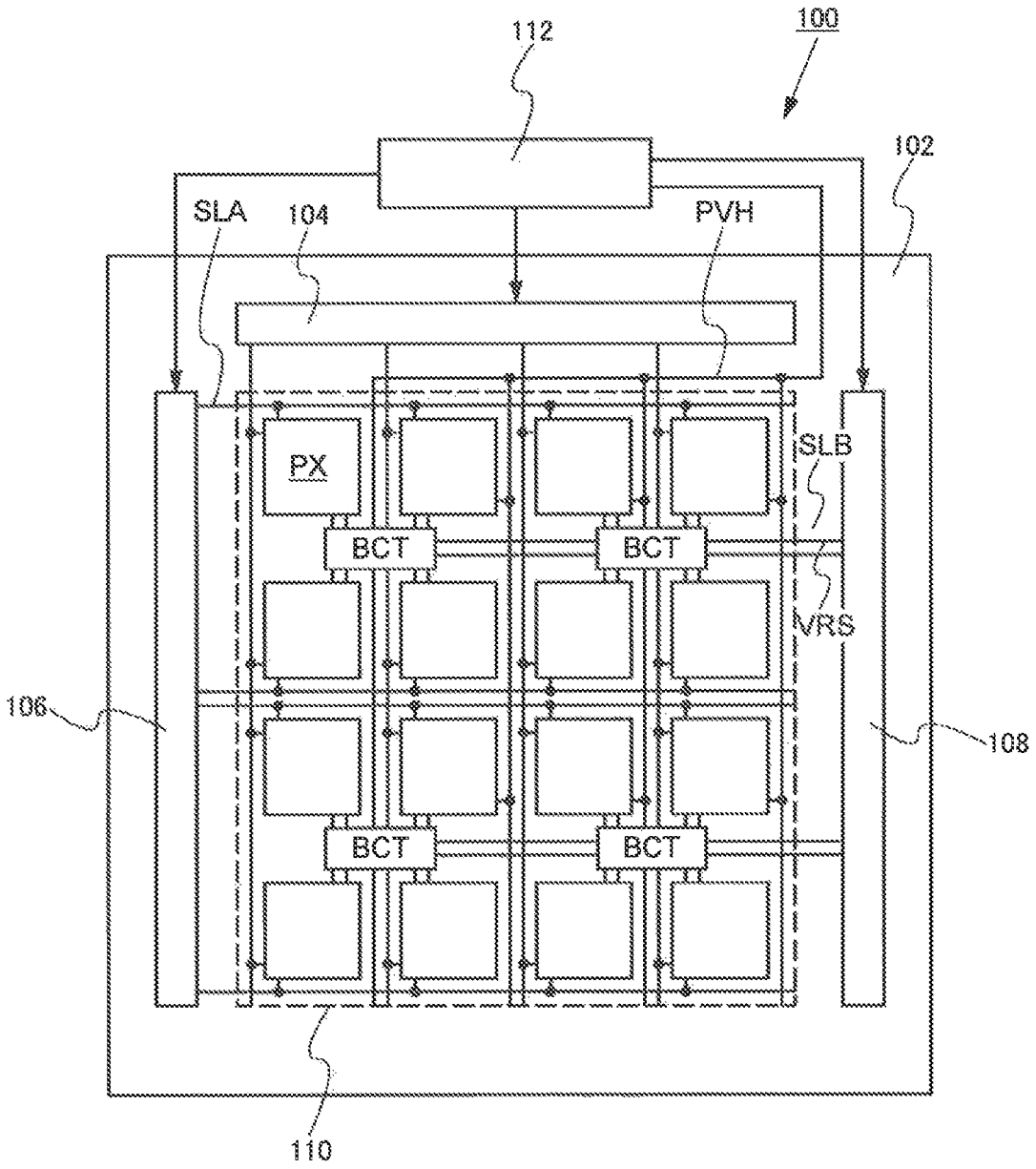
FIG. 11 is a diagram showing a schematic diagram of a display device related to one embodiment of the present invention.

In FIG. 11, each pixel PX shares a second switch BCT between adjacent rows. In FIG. 11, four pixels adjacent to each other in a row direction and column direction share one second switch BCT. Furthermore, although the second switch is share by each pixel PX, since the function is the same as in the first embodiment, the equivalent circuit of a pixel is the same as that shown in FIG. 2.

Figure 12:
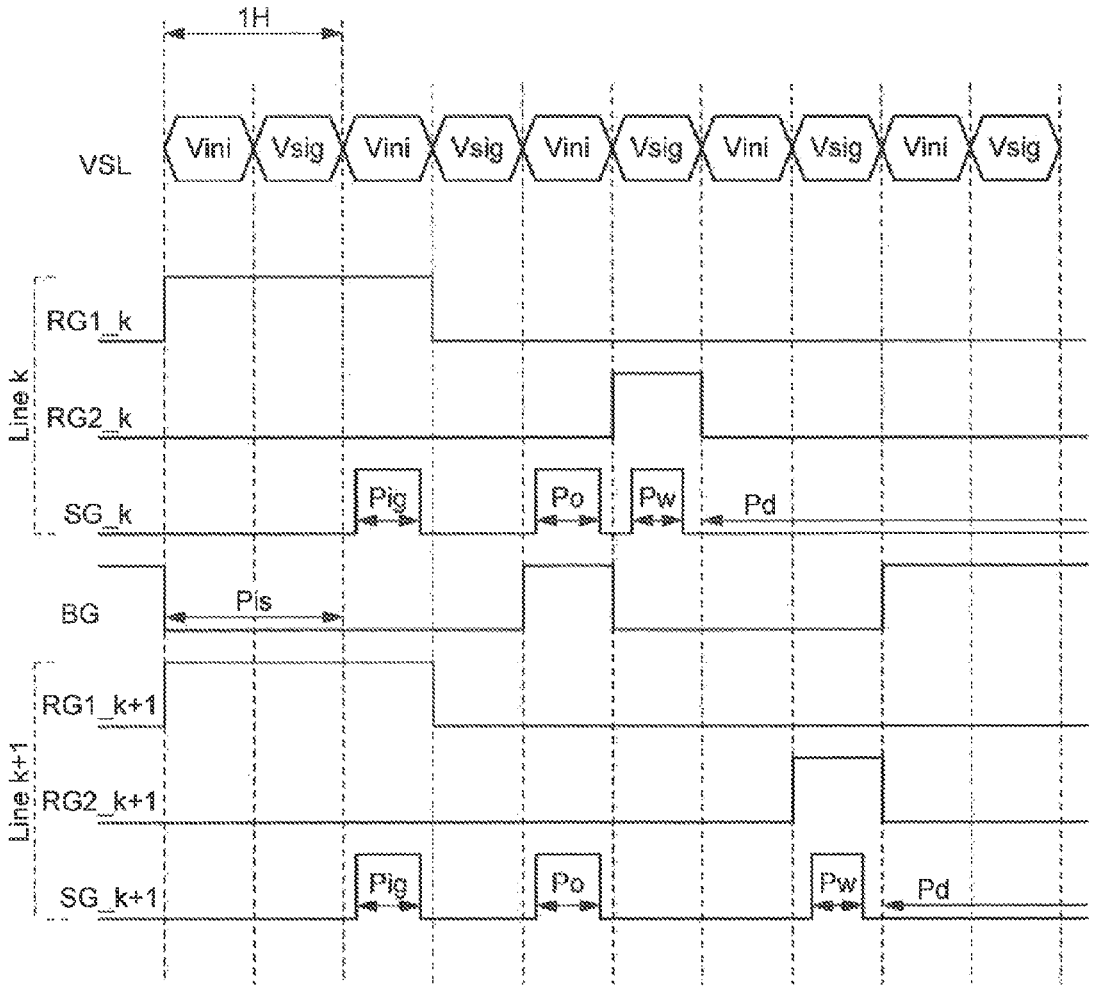
FIG. 12 is a timing chart for explaining an operation of a display device related to one embodiment of the present invention.

Operation of a Display Device:

FIG. 12 shows a timing chart for explaining the operation of a pixel circuit related to the present embodiment. In FIG. 12, the operation of a kth row and k+1 row which is the next row of the display part 110 is explained. In addition, adjacent pixels PX share a second switch BCT in the kth row and k+1 row which is the next row. In FIG. 12, the control signal BG of the second scanning line is a signal for switching the second switch BCT ON and OFF.

A source initialization period Pis is arranged in FIG. 12. In the source initialization period Pis, the same operation is performed for a kth row pixel PX_k and a k+1 row pixel PX_k+1. With respect to the kth row pixel PX_k, the control signal SG_k of the first scanning line SLA_k is set to a voltage level (low level voltage VGL) which switches the first switch SST to OFF, the control signal RG1_*k* of the first control line SLC is set to a voltage level (high level voltage VGH) which switches the third switch RST1 to ON, and the control signal RG2_*k* of the second control line SLD is set to a voltage level (low level voltage VGL) which switches the fourth switch RST2 to OFF. The same settings are used for the k+1 row pixel PX_k+1. The control signal BG of the second scanning line SLB is set to a voltage level (low level voltage VGL) which switches the second switch BCT to OFF.

In this way, in the kth row pixel PX_k, the first switch SST_k is OFF (non-conductive state), the second switch BCT is OFF (non-conductive state, the third switch RST1_*k* is ON (conductive state), the fourth switch RST2 is OFF (non-conductive state) and the source initialization operation begins. The k+1 row pixel PX_k+1 are also the same and the source initialization operation begins. The source and drain of a driving transistor DRT_k of the pixel PX_k and a driving transistor DRT_k+1 of the pixel PX_k+1 are each reset to the same voltage as the first reset voltage (reset voltage Vrst1) respectively.

After the source initialization period, a gate initialization period Pig (gate initialization operation) begins. In the gate initialization period Pig, the same operation is performed for a kth row pixel PX_k and a k+1 row pixel PX_k+1. In the kth row pixel PX_k, the control signal SG_k of the first scanning line SLA_k is set to a voltage level (high level voltage VGH) which switches the first switch SST to ON, the control signal RG1_*k* of the first control line SLC_k is set to a voltage level (high level voltage VGH) which switches the third switch RST1 to ON, and the control signal RG2_*k* of the second control line SLD is set to a voltage level (low level voltage VGL) which switches the fourth switch RST2 to OFF. The same settings are used for the k+1 row pixel PX_k+1. The control signal BG of the second scanning line SLB is set to a voltage level (low level voltage VGL) which switches the second switch BCT to OFF.

In the kth row pixel PX_k in the gate initialization period Pig, an initialization signal Vini (initialization voltage) output from the first signal line VSL_k is applied to the gate of the driving transistor DRT_k after passing through the first switch SST_k. In this way, the voltage of the gate of the driving transistor DRT_k is reset to a voltage corresponding to the initialization signal Vini and data of the previous frame is returned to an initial state. The k+1 row pixel PX_k+1 are also the same and the voltage of the gate of the driving transistor DRT_k+1 is reset to a voltage corresponding to the initialization signal Vini.

Next, the process moves to an offset cancel period Po. In the gate initialization period Pig, the same operation is carried out in the kth row pixel PX_k and k+1 row pixel PX_k+1. In the kth row pixel PX_k, the control signal SG_k of the first scanning line SLA_k is set to a voltage level (high level voltage VGH) which switches the first switch SST to ON, the control signal RG1_*k* of the first control line SLC_k is set to a voltage level (low level voltage VGL) which switches the third switch RST1 to ON, and the control signal RG2_*k* of the second control line SLD is set to a voltage level (low level voltage VGL) which switches the fourth switch RST2 to OFF. The same settings are used for the k+1 row pixel PX_k+1. The control signal BG_k of the second scanning line SLB is set to a voltage level (high level voltage VGH) which switches the second switch BCT to ON.

In the offset cancel period Po, the initialization signal Vini is supplied to the gate of the driving transistor DRT_k in the kth row pixel PX_k via the first signal line VSL and first switch SST_k, and the gate voltage of the driving transistor DRT_k is fixed. The settings are also the same in the driving transistor DRT_k+1 in the kth+1 row pixel PX_k+1.

In addition, the second switch BCT is ON, a current flows into the driving transistor DRT_k and driving transistor DRT_k+1 from the first power supply line PVH, and the voltage of the source of the driving transistor DRT_k and driving transistor DRT_k+1 is shifted to a high voltage side by setting the voltage (first reset voltage Vrst1) written in the initialization period Pis so as to compensate for any variation in transistor characteristics of the driving transistor DRT while gradually reducing the current passing between the driving transistor DRT_k and driving transistor DRT_k+1.

A high voltage PVDD is applied from the first power supply line PVH to the drain of the driving transistor DRT_k and driving transistor DRT_k+1 and the amount of current becomes a sufficiently large value. Therefore, the current passing between the driving transistor DRT_k and driving transistor DRT_k+1 continues to be reduced in a comparatively short period of time.

At the point when the offset cancel period Po is finished, the source voltage of the driving transistor DRT_k is Vini−Vthk and the source voltage of the driving transistor DRT_k+1 is Vini−Vthk+1. In this way, the voltage between the gate and source of the Vini−Vthk driving transistor DRT_k reaches Vthk and a potential difference corresponding to Vthk is accumulated (stored) in the capacitor element CS. The driving transistor DRT_k+1 is also the same.

Next, the video signal writing period Pw begins. In the video signal writing period Pw, a video signal Vsig_k is written to the kth row pixel PX_k and a video signal Vsig_k+1 is written to the k+1 row pixel PX_k+1 in sequence for each row.

First, in the kth row pixel PX_k, the control signal SG_k of the first scanning line SLA_k is set to a voltage level (high level voltage VGH) which switches the first switch SST to ON, the control signal RG1_*k* of the first control line SLC_k is set to a voltage level (low level voltage VGL) which switches the third switch RST1 to OFF, and the control signal RG2_*k* of the second control line is set to a voltage level (high level voltage VGH) which switches the fourth switch RST2_*k* to ON. At this time, in the k+1 row pixel PX_k+1, the control signal SG_k+1 of the first scanning line SLA_k+1 is set to a voltage level (low level voltage VGL) which switches the first switch SST_k+1 to OFF, the control signal RG1_*k*+1 of the first control line SLC_k+1 is set to a voltage level (low level voltage VGL) which switches the third switch RST1_*k*+1 to OFF, and the control signal RG2_*k*+1 of the second control line is set to a voltage level (low level voltage VGH) which switches the fourth switch RST2_*k*+1 to OFF.

In the video signal writing period Pw, a video signal Vsig_k passes through the first switch SST_k from the first signal line VSL_k and is written to the gate electrode of the driving transistor DRT_k. In addition, a second reset voltage Vrst2*k* is supplied to the drain of the driving transistor DRT_k via the second reset signal line VRS2_*k* and fourth switch RST2_*k*. In this way, a current flows between the drain and source of the driving transistor DRT_k and to the second power supply line PVL via the capacitor part (parasitic capacitor) Celk of the light emitting element EMD_k. By the series of operations up to this point, the video signal Vsig_k and a voltage based on a threshold voltage to be obtained during an offset cancel operation are written to the gate of the driving transistor DRT_k, and any variation in the level of movement of the driving transistor DRT_k is corrected.

Next, a writing operation of a video signal to the k+1 row pixel PX_k+1 is performed. In the k+1 row pixel PX_k+1, the control signal SG_k+1 of the first scanning line SLA_k+1 is set to a voltage level (high level voltage VGH) which switches the first switch SST_k+1 to ON, the control signal RG1_*k*+1 of the first control line SLC_k+1 is set to a voltage level (low level voltage VGL) which switches the third switch RST1_*k*+1 to OFF, and the control signal RG2_*k*+1 of the second control line is set to a voltage level (high level voltage VGH) which switches the fourth switch RST2_*k*+1 to ON. The control signal BG of the second scanning line SLB is set to a voltage level (low level voltage VGL) which switches the second switch BCT to OFF. At this time, in the kth row pixel PX_k, the control signal SG_k of the first scanning line SLA_k is set to a voltage level (low level voltage VGL) which switches the first switch SST_k to OFF, the control signal RG1_*k* of the first control line SLC_k is set to a voltage level (low level voltage VGL) which switches the third switch RST1_*k* to OFF, and the control signal RG2_*k* of the second control line is set to a voltage level (low level voltage VGL) which switches the fourth switch RST2_*k* to OFF.

A light emitting period Pd begins simultaneously for the kth row pixel PX_k and k+1 row pixel PX_k+1. In the kth row pixel PX_k in the light emitting period Pd, the control signal SG_k of the first scanning line SLA_k is set to a voltage level (low level voltage VGL) which switches the first switch SST_k to OFF, the control signal RG1_*k* of the first control line SLC_k is set to a voltage level (low level voltage VGL) which switches the third switch RST1_*k* to OFF, and the control signal RG2_*k* of the second control line is set to a voltage level (low level voltage VGL) which switches the fourth switch RST2_*k* to OFF. The k+1 row pixel PX_k+1 is also the same.

The control signal BG of the second scanning line is set to a voltage (high level voltage VGH) which switches the second switch BCT to ON, and the driving transistor DRT_k outputs a drain current Ie_k of a current amount corresponding to a gate control voltage written to the capacitor element CS_k. The drain current Ie_k is supplied to the light emitting element EMD_k. In this way, the light emitting element EMD_k emits light at a luminosity according to the drain current Ie_k and a display operation is performed. The k+1 row pixel PX_k+1 is also the same.

According to the present embodiment, it is possible to perform similar operations as the first embodiment in each pixel while continuing to share a second switch between adjacent rows. That is, according to the display device and driving method thereof related to the present embodiment, it is possible to demonstrate the same effects as those in the first embodiment. In this way, it is possible to reduce the time required for an offset cancel operation (compensation of a threshold voltage) of a driving transistor while also reducing the number of transistors and number of wires in a display part.

Furthermore, in the present embodiment, several offset cancel periods may be arranged as explained in the second embodiment. In addition, in the case where several offset cancel periods are arranged, the voltages applied to the drain of a driving transistor may be made different as explained in the third embodiment.

What is claimed is:

1. A method of driving a display device, the display device includes a plurality of pixels, each of the plurality of pixels includes a light emitting element arranged between a first power supply line applied with a first voltage and a second power supply line applied with a second voltage lower than the first voltage, a driving transistor arranged between the light emitting element and the first power supply line, a source of the driving transistor is electrically connected to the light emitting element, a first switch controlling an electrical connection between a gate of the driving transistor and a signal line supplied with a video signal and an initialization voltage, a second switch controlling an electrical connection between the first power supply line and a drain of the driving transistor, the drain of the drive transistor is connected to a first reset switch and a second reset switch in parallel, wherein the first reset switch controlling an applying of a first reset voltage to the drain of the drive transistor, and the second reset switch controlling an applying of a second reset voltage to the drain of the drive transistor, the method of driving the display device includes the following steps:

a step of switching the first switch and the second switch to OFF, and the first reset switch to ON in a source initialization period and applying the first reset voltage to the drain of the driving transistor;

a step of switching the first switch to ON and the second switch to OFF in a gate initialization period following the source initialization period, and applying an initialization voltage higher than the first reset voltage to the gate of the driving transistor from the signal line;

a step of switching the first switch and the second switch to ON in an offset cancel period following the gate initialization period, applying the initialization voltage to the gate of the driving transistor, supplying a current to the driving transistor from the first power supply line and shifting a source voltage to a high voltage side;

a step of switching the first switch to ON, the second switch to OFF and the second reset switch to ON in a video signal writing period following the offset cancel period, applying the video signal to the gate of the driving transistor, and applying the second reset voltage higher than the first reset voltage and lower than the first voltage to the drain of the driving transistor; and a step of switching the first switch to OFF and the second switch to ON in an emission period following the video signal writing period, and supplying a current from the first power supply line to the light emitting element according to a gate voltage of the driving transistor, wherein at least a part of the offset cancel period has a period in which both of the first reset switch and the second reset switch are OFF.

2. The method of driving a display device according to claim 1, wherein the offset cancel period includes a first offset cancel period and a second offset cancel period, both of the first reset switch and the second reset switch are OFF in the first offset cancel period, and the second reset switch is turned ON and the second reset voltage is applied to the drain of the drive transistor in the second offset cancel period.

3. The method of driving a display device according to claim 1, wherein the plurality of pixels are arranged in a row direction and a column direction, and an operation in the source initialization period, an operation in the gate initialization period and an operation in the offset cancel period are performed simultaneously on two adjacent rows.

4. A display device comprising a plurality of pixels and a driving circuit, each of the plurality of pixels includes:

a first power supply line applied with a first voltage;

a light emitting element arranged between the first power supply line applied with the first voltage and a second power supply line applied with a second voltage lower than the first voltage;

a driving transistor arranged between the light emitting element and the first power supply line, a source of the driving transistor is electrically connected to the light emitting element;

a first switch controlling an electrical connection between a signal line supplied with a video signal and an initialization voltage, and a gate of the driving transistor;

a second switch controlling an electrical connection between the first power supply line and a drain of the driving transistor;

the driving circuit includes:

a first reset switch controlling an applying of a first reset voltage to the drain of the drive transistor; and a second reset switch controlling an applying of a second reset voltage to the drain of the drive transistor, wherein the driving circuit controlling an ON/OFF operation of the first switch, the second switch, the first reset switch and the second reset switch, applying a video signal and an initialization voltage to the signal line, and applying a first reset voltage and a second voltage to the driving transistor, the driving circuit is configured to control the following steps of:

a source initialization period for switching the first switch and the second switch to OFF, the first rest switch to ON and applying the first reset voltage to a drain of the driving transistor;

a gate initialization period following the source initialization period for switching the first switch to ON and the second switch to OFF, and applying an initialization voltage higher than the first reset voltage to a gate of the driving transistor from the signal line;

an offset cancel period following the gate initialization period for switching the first switch and the second switch to ON, applying the initialization voltage to the gate of the driving transistor, supplying a current to the driving transistor from the first power supply line, and shifting a source voltage to a high voltage side;

a video signal writing period following the offset cancel period for switching the first switch ON, and the second switch to OFF, and the second reset switch to ON, applying the video signal to the gate of the driving transistor, and applying the second reset voltage higher than the first reset voltage and lower than a voltage of the first power supply line to the drain of the driving transistor; and an emission period following the video signal writing period for switching the first switch to OFF and the second switch to ON, and supplying a current from the first power supply line to the light emitting element according to a gate voltage of the driving transistor, wherein at least a part of the offset cancel period has a period which both of the first reset switch and the second reset switch are OFF.

5. The display device according to claim 4, wherein the offset cancel period includes a first offset cancel period and a second offset cancel period, both of the first reset switch and the second reset switch are OFF in the first offset cancel period, and the second reset switch is turned ON and the second reset voltage is applied to the drain of the drive transistor in the second offset cancel period.

6. The display device according to claim 5, wherein the plurality of pixels are arranged in a row direction and a column direction, and the source initialization period, the gate initialization period, the first offset cancel period and the second offset cancel period are performed simultaneously on two adjacent rows.

7. The display device according to claim 4, wherein the plurality of pixels are arranged in a row direction and a column direction, and the source initialization period, the gate initialization period, the offset cancel period is performed simultaneously on two adjacent rows.

* * * * *